US006725002B2

(12) United States Patent
Sakurai et al.

(10) Patent No.: US 6,725,002 B2
(45) Date of Patent: Apr. 20, 2004

(54) PROCESS CARTRIDGE, ELECTROPHOTOGRAPHIC APPARATUS AND IMAGE FORMING METHOD

(75) Inventors: Yuji Sakurai, Shizuoka (JP); Hiroyuki Kobayashi, Shizuoka (JP); Akihiko Nakazawa, Shizuoka (JP); Atsushi Tanaka, Shizuoka (JP); Tsunenori Ashibe, Kanagawa (JP); Takashi Kusaba, Shizuoka (JP); Hidekazu Matsuda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 12 days.

(21) Appl. No.: 10/230,208

(22) Filed: Aug. 29, 2002

(65) Prior Publication Data

US 2003/0099483 A1 May 29, 2003

(30) Foreign Application Priority Data

Aug. 31, 2001 (JP) ..... 2001-263910

(51) Int. Cl.[7] ..... G03G 21/16
(52) U.S. Cl. ..... 399/111
(58) Field of Search ..... 399/107, 111, 399/116, 302, 308

(56) References Cited

U.S. PATENT DOCUMENTS

| | | | | |
|---|---|---|---|---|
| 5,116,711 A | | 5/1992 | Kobayashi et al. | 430/106 |
| 5,149,610 A | | 9/1992 | Kobayashi et al. | 430/106 |
| 5,164,275 A | | 11/1992 | Kobayashi et al. | 430/45 |
| 5,170,209 A | | 12/1992 | Tompkins et al. | 399/107 |
| 5,256,512 A | | 10/1993 | Kobayashi et al. | 430/106 |
| 5,440,373 A | | 8/1995 | Deki et al. | 399/113 |
| 5,587,769 A | | 12/1996 | Sawada et al. | 399/113 |
| 5,887,228 A | * | 3/1999 | Motohashi et al. | 399/111 |
| 6,094,556 A | | 7/2000 | Tanaka et al. | 399/302 |
| 6,115,568 A | | 9/2000 | Sameshima | 399/110 |

FOREIGN PATENT DOCUMENTS

| | | |
|---|---|---|
| JP | 63-301960 | 12/1988 |
| JP | 5-31818 | 2/1993 |
| JP | 6-110261 | 4/1994 |
| JP | 8-137181 | 5/1996 |
| JP | 8-314231 | 11/1996 |
| JP | 10-63111 | 3/1998 |
| JP | 10-177329 | 6/1998 |
| JP | 11-30944 | 2/1999 |

OTHER PUBLICATIONS

Patent Abstracts of Japan, No. 8, vol. 1998, 6/98.

* cited by examiner

*Primary Examiner*—Hoan Tran
(74) *Attorney, Agent, or Firm*—Fitzpatrick, Cella, Harper & Scinto

(57) ABSTRACT

A process cartridge detachably mountable to the electrophotographic apparatus main body, integrally including an electrophotographic photosensitive member to carry a toner image; an intermediate transfer belt having a contact part with the photosensitive member; primary transfer member to primarily transfer the toner image from the photosensitive member to the intermediate transfer belt; and electric charge member to give electric charges in polarity opposite to the polarity of the toner at the time of the primary transfer to the toner on the intermediate transfer belt to return the toner on the intermediate transfer belt to the photosensitive member at the contact part to clean the intermediate transfer belt, wherein the intermediate transfer belt has an average glossiness of 30 to 90; glossiness deviation within 10; average film thickness of 40 to 200 $\mu$m; and film thickness unevenness within ±20% relative to the average film thickness. Also, an electrophotographic apparatus having the process cartridge and an image forming method using the electrophotographic apparatus are disclosed.

15 Claims, 8 Drawing Sheets

PROCESS CARTRIDGE, ELECTROPHOTOGRAPHIC APPARATUS AND IMAGE FORMING METHOD

BACKGROUND OF THE INVENTION

1. Field of the Invention

The present invention relates to a process cartridge, an electrophotographic apparatus, an image forming method and an intermediate transfer belt.

2. Related Background Art

Image forming apparatus of electrophotographic system (electrophotographic apparatus) using an intermediate transfer belt is effective as a full color electrophotographic apparatus and a multi-color image forming apparatus that perform sequential laminated transfer of a plurality of component color images of full color image information or multi-color image information to output image forming product that is synthesized and reproduced from the full color image or the multi-color image.

Compared with a conventional transferring apparatus of a full color electrophotographic apparatus (for example, described in Japanese Patent Application Laid-Open No. 63-301960) having an electrophotographic apparatus wherein images are transferred from an electrophotographic photosensitive member to a second image bearing member fastened or attracted onto a transferring drum, a full color electrophotographic apparatus using an intermediate transfer belt does not require any processing or control on the transfer material but can transfer images from the intermediate transfer belt to a transfer material, and therefore has an advantage that various kinds of second image bearing member can be selected regardless of wideness/narrowness of width or longness/shortness of length to cover thin paper (40 $g/m^2$ paper) to thick paper (200 $g/m^2$ paper).

In addition, compared with such a case where rigid cylinder such as an intermediate transfer drum is used, adopting an intermediate belt shape, freedom for disposing inside an electrophotographic apparatus increases, giving rise to an advantage that miniaturization or cost reduction of the main body of the apparatus can be implemented by efficiently utilizing spaces.

However, the life of the intermediate transfer belt is shorter than the main body, and replacement is indispensable under the current state.

In addition, a waste toner container that collects residual developer (hereunder referred to as toner) in the intermediate transfer belt needs to be disposed and treated.

In addition to these, a lot of components such as electrophotographic photosensitive member, developing means and toner, etc. for a printer and a photocopier will need replacement.

As a method to unitize these replacement components and attach to/remove from the main body easily, Japanese Patent Application Laid-Open No. 8-137181 proposes to dispose an intermediate transfer belt and an electrophotographic photosensitive member as respectively independent units detachably mountable to the main body without difficulty.

However, these means involve a number of replacement units to make user's operation complicated. Moreover, each unit is designed and disposed independently, thereby giving rise to such a problem that the main body gets larger or costs increase.

As means to solve this problem, replacing means to simultaneously remove from/attach to the main body the intermediate transfer belt and the electrophotographic photosensitive member (replacement components) as one-body unit are suitable, and are proposed in Japanese Patent Application Laid-Open No. 6-110261, Japanese Patent Application Laid-Open No. 10-177329 and Japanese Patent Application Laid-Open No. 11-30944 etc.

However, in the method to construct the intermediate transfer belt and the electrophotographic photosensitive member as one-body unit, that is, an intermediate transfer belt-electrophotographic photosensitive member integrated process cartridge (hereinafter to be referred to simply as "integrated process cartridge" as well), the integrated process cartridge as a whole must be replaced even when a problem takes place in the intermediate transfer belt, which on the contrary might increase costs.

In general, in a full color electrophotographic apparatus, image density could be varied due to change in environments for use, or original correct color tone could become unavailable.

Therefore, in case of a full color electrophotographic apparatus using an intermediate transfer belt, it comprises density detecting means as means to obtain accurate density information, bringing density detecting toner image (patch) for respective colors produced on the intermediate transfer belt into radiation with a predetermined light so as to detect density from reflection rates of that reflection light and the intermediate transfer belt and to control image density by feeding the detection results back to the exposure amount and the developing bias, etc. Thus, it is important that glossiness of the surface of the intermediate transfer belt is stable all over the circumference of the belt.

However, at the time of shipment of the integrated process cartridge, or in the case where a user removes and conveys the integrated process cartridge, due to contact between the intermediate transfer belt and the electrophotographic photosensitive member, the intermediate transfer belt and the electrophotographic photosensitive member suffer from vibration, mutual friction, or rubbing frequently and repeatedly. Therefore, cuts and scrapes are given rise to onto the surface of the intermediate transfer belt, and glossiness of the intermediate transfer belt in the contact part decreases.

In addition, while the integrated process cartridge is kept for a long time at the time of shipment, components constructing the intermediate transfer belt and the electrophotographic photosensitive member are oozed so that the contact part fogs and the glossiness decreases.

In addition, increase in number of print causes accumulation of dirt on the surface of the intermediate transfer belt due to toner and paper dust, or occurrence of micro cuts or scratches so that the glossiness of the intermediate transfer belt decreases.

Moreover, in the intermediate transfer belt-electrophotographic photosensitive member integrated process cartridge, the intermediate transfer belt is always brought into contact with the electrophotographic photosensitive member, friction between the intermediate transfer belt and the electrophotographic photosensitive member not only reduces glossiness on the surface of the intermediate transfer belt as a whole but also gives rise to unevenness in glossiness. As a result, density detection is not executed accurately, giving rise to density unevenness for each image. In addition, a belt with glossiness unevenness from the initial period of use intensifies unevenness as it is used, and density unevenness on each image gets worse.

On the other hand, in the electrophotographic apparatus with the intermediate transfer belt and the electrophotographic photosensitive member being respectively independent units, even if the belt used has a glossiness unevenness, that unevenness changes little.

SUMMARY OF THE INVENTION

A purpose of the present invention is to provide an intermediate transfer belt-electrophotographic photosensitive member integrated process cartridge that makes maintenance easy, can attain miniaturization as well as cost reduction of the apparatus, can perform density detecting measuring for controlling image forming conditions in more stable and more accurate fashion, and can provide excellent images corresponding with use conditions, a electrophotographic apparatus having the above-described process cartridge, and an image forming method using the above-described electrophotographic apparatus.

In order to solve the above-described problem, the present inventors have intensified their consideration and found out that it works well with the average glossiness of the intermediate transfer belt being 30 to 90 and its deviation being within 10.

Moreover, the intermediate transfer belt-electrophotographic photosensitive member integrated process cartridge mostly is at a standstill with tension being applied for a long period until it is actually used, bending habit will be given in the portion of a spanning roller, execution of density detection in this portion does not provide accurate reflection light, giving rise to density unevenness in each image as a result thereof.

Also, in order to solve the above-described problem, the present inventors have intensified their consideration and found out that it works well with the average film thickness of the intermediate transfer belt being 40 $\mu$m to 200 $\mu$m and further with its unevenness being within ±20% relative to the average value.

That is, the present invention provides a process cartridge detachably mountable to an electrophotographic apparatus main body, the process cartridge integrally comprising:

an electrophotographic photosensitive member to carry a toner image;

an intermediate transfer belt having a contact part with the electrophotographic photosensitive member;

primary transfer means to primarily transfer the toner image at the contact part from the electrophotographic photosensitive member to the intermediate transfer belt; and electric charge providing means to give electric charges in polarity opposite to the polarity of the toner at the time of the primary transfer to the toner on the intermediate transfer belt to return the toner on the intermediate transfer belt to the electrophotographic photosensitive member at the contact part to clean the intermediate transfer belt, wherein the intermediate transfer belt has an average glossiness, obtained in the circumference direction, of 30 to 90;

a glossiness deviation of within 10;

an average film thickness of 40 to 200 $\mu$m; and a film thickness unevenness of within ±20% relative to the average film thickness.

In addition, the present invention provides an electrophotographic apparatus comprising:

an electrophotographic photosensitive member to carry a toner image;

charging means to charge the electrophotographic photosensitive member;

exposing means to form an electrostatic latent image on the electrophotographic photosensitive member charged with the charging means;

developing means to develop with toner the electrostatic latent image on the electrophotographic photosensitive member formed with the exposing means to form a toner image on the electrophotographic photosensitive member;

an intermediate transfer belt having a contact part with the electrophotographic photosensitive member to perform, after the primary transfer of the toner image from the electrophotographic photosensitive member to the intermediate transfer belt, secondary transfer of the primarily transferred toner image to a transfer material;

primary transfer means to primarily transfer the toner image from the electrophotographic photosensitive member to the intermediate transfer belt at the contact part;

electric charge providing means to give electric charges in polarity opposite to the polarity of the toner at the time of the primary transfer to the toner on the intermediate transfer belt to return the toner on the intermediate transfer belt to the electrophotographic photosensitive member at the contact part to clean the intermediate transfer belt, and a process cartridge integrally comprising at least the electrophotographic photosensitive member, the intermediate transfer belt, the primary transfer means and the electric charge providing means and being detachably mountable to the electrophotographic apparatus main body, wherein the intermediate transfer belt has an average glossiness, obtained in the circumference direction, of 30 to 90;

a glossiness deviation of within 10;

an average film thickness of 40 to 200 $\mu$m; and a film thickness unevenness of within ±20% relative to the average film thickness.

In addition, the present invention provides an image forming method comprising:

a charging step to charge an electrophotographic photosensitive member;

an exposing step to form an electrostatic latent image on the electrophotographic photosensitive member charged in the charging step;

a developing step to develop with a toner the electrostatic latent image on the electrophotographic photosensitive member formed in the exposing step to form a toner image on the electrophotographic photosensitive member;

a primary transfer step to primarily transfer the toner image formed in the developing step, with primary transfer means, from the electrophotographic photosensitive member to the intermediate transfer belt having a contact part with the electrophotographic photosensitive member;

a secondary transfer step to secondarily transfer the toner image primarily transferred in the primary transfer step to a transfer material;

an electric charge providing step to give electric charges in polarity opposite to the polarity of the toner at the time of the primary transfer step to the toner on the intermediate transfer belt with electric charge providing means; and an intermediate transfer belt cleaning step to return the toner on the intermediate transfer belt to the electrophotographic photosensitive member at the contact part to clean the intermediate transfer belt, the image forming method using the electrophotographic apparatus having a process cartridge, the process cartridge integrally comprising at least the electrophotographic photosensitive member, the intermediate transfer belt, the primary transfer means and the electric charge providing means and being detachably mountable to the electrophotographic apparatus main body, wherein the intermediate transfer belt has an average glossiness, obtained in the circumference direction, of 30 to 90;

a glossiness deviation of within 10;

an average film thickness of 40 to 200 $\mu$m; and a film thickness unevenness of within ±20% relative to the average film thickness.

In addition, the present invention is an intermediate transfer belt for the above-described process cartridge.

Incidentally, in Japanese Patent Application Laid-Open No. 10-63111, a method to decrease changes in glossiness of the intermediate transfer member is disclosed and only the average glossiness of the intermediate transfer belt is described. There are no statements on film thickness of the intermediate transfer belt and its unevenness.

In addition, in Japanese Patent Application Laid-Open No. 5-31818, a method of producing a belt having uniform surface is disclosed. There are no statements on film thickness of the intermediate transfer belt and its unevenness.

DESCRIPTION OF THE PREFERRED EMBODIMENTS

Figure 1:
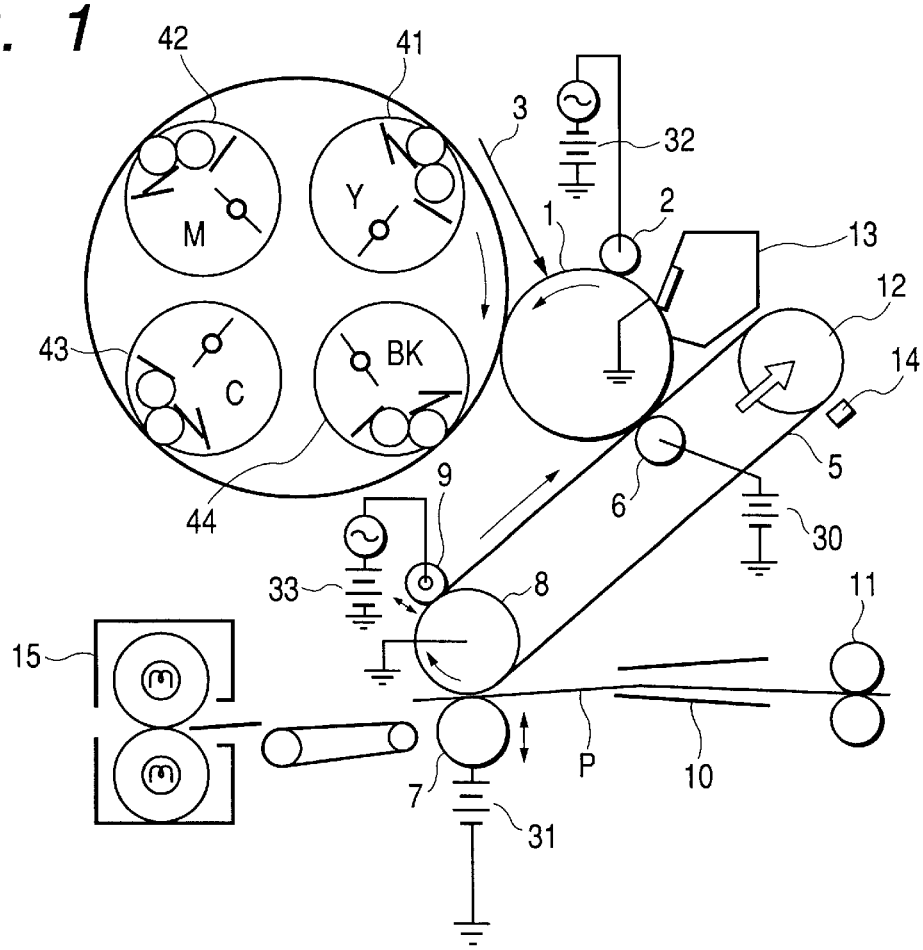
FIG. 1 is a schematic view of an electrophotographic apparatus comprising an intermediate transfer belt-electrophotographic photosensitive member integrated process cartridge of the present invention.

Embodiments of the present invention will be described in detail below.

In the present invention, as a result of consideration on simplification of maintenance as well as miniaturization of a main body as well as a process cartridge, cost reduction and improvement in image quality, an initial goal has been attained with an intermediate transfer belt-electrophotographic photosensitive member integrated process cartridge, together with further several measures.

Firstly for miniaturization and cost reduction of a process cartridge, as a system of cleaning the intermediate transfer belt, a primary transfer-simultaneous cleaning system is adopted that gets a transfer residual toner electrified to a reverse polarity to return to the electrophotographic photosensitive member simultaneously at the time of the primary transfer.

In particular, the method is to apply a voltage to electric charge giving means (for example, in a roller shape) disposed detachably-attachable onto the intermediate transfer belt to give electric charges to a second transfer residual toner with reverse polarity against the primary transfer so as to get back to the electrophotographic photosensitive member in the subsequent primary transfer part with a primary transfer electric field.

The toner brought back to the electrophotographic photosensitive member from the intermediate transfer belt is preferably removed with a cleaning mechanism of the electrophotographic photosensitive member such as a cleaning blade, etc.

This system gives rise to a significant effect in miniaturization and cost reduction of process cartridge compared with a system with cleaning blades, etc. being provided in the both of the electrophotographic photosensitive member and the intermediate transfer belt and with a mechanism for feeding waste toner and a container for waste toner being provided.

For an intermediate transfer belt that can secure a stable and accurate density measurement to control image forming conditions and can provide most excellent images corresponding with usage conditions, average glossiness in the belt surface should be 30 to 90, preferably 40 to 85, more preferably 40 to 70. With the average glossiness being less than 30, reflecting light intensity from the intermediate transfer belt cannot be provided and does not permit accurate density detection. In addition, with glossiness being more than 90, the glossiness of the intermediate transfer belt in the contact part with the electrophotographic photosensitive member is significantly reduced at the time when a one-body integral process cartridge is shipped or is kept in custody. In addition, as printing is carried out, the surface condition of the belt gets rapidly coarse and glossiness is significantly reduced. Therefore, accurate density detection cannot be executed.

In addition, deviation of glossiness must be within 10, and is preferably within 9, more preferably within 5. With deviation of glossiness being more than 10, unevenness of reflection light will get bigger to give rise to unevenness in density detection results and give rise to density unevenness in each image. In addition, the intermediate transfer belt with uneven glossiness suffers from sizable reduction in glossiness in the contact part with the electrophotographic photosensitive member at the time of its shipment or storage, giving rise to expansion in unevenness, or as printing is repeated, unevenness is expanded, resulting in further worsening in density unevenness for each image.

Film thickness of the intermediate transfer belt for use in the process cartridge of the present invention is 40 to 200 $\mu$m, preferably 50 to 150 $\mu$m, and more preferably 60 to 140

μm. With the film thickness being more than 200 μm, bending habit will be given to the intermediate transfer belt in the portion of the spanning roller, and execution of density detection in this portion does not provide accurate reflection light, giving rise to density unevenness in each image as a result thereof. In addition, the film thickness being less than 40 μm will not provide sufficient endurance intensity, giving rise to tearing or crack in the belt.

In addition, unevenness of film thickness must be within ±20% relative to an average value, and is preferably within ±12%, and more preferably within ±10%. With the unevenness of film thickness being more than ±20%, bending habit will be given to the intermediate transfer belt in the portion where the film is thick, and density detection will not be able to be executed accurately in this portion.

Incidentally, respective measurement conditions were set as follows.

<Glossiness Measuring Method>

Glossiness of an intermediate transfer belt to be used for a process cartridge of the present invention was measured and averaged at 20 points over the belt with equal interval in the center of the belt in the circumference direction with a handy gross meter IG 320 produced by Horiba, Ltd.

In addition, deviation of glossiness is a value by subtraction between the maximum value and the minimum value.

<Film Thickness Measuring Method>

Film thickness of the intermediate transfer belt for use in the process cartridge of the present invention is values measured and averaged at 20 points over all the belt with equal interval in the center of the belt in the circumference direction in a dial gauge with the minimum value of 1 μm.

At the primary transfer, pressing pressure of the intermediate transfer belt against the electrophotographic photosensitive member is preferably 1N to 50N and more preferably 5N to 20N. When the pressing pressure surpasses 50N, friction between the intermediate transfer belt and the electrophotographic photosensitive member gets larger and an abrasion might occur, and occurrence of abrasion may cause glossiness unevenness. In addition, with the pressing pressure being less than 1N, the primary transfer may not be executed well and could cause defects in image.

Among extrusion materials to be used for an intermediate transfer belt for use in the process cartridge of the present invention, for a resin being a main material, which is not limited in particular if it fulfills features of the present invention, olefin resin such as polyethylene and polypropylene, polystyrene resin, acrylic resin, polyester resin, polycarbonate, sulfur-containing resins such as polysulfone and polyether sulfone as well as polyphenylene sulfide, etc., fluorine resins such as polyvinylidene fluoride and polyethylene-tetrafluoroethylene copolymer, etc., polyurethane resin, silicon resin, ketone resin, polyvinylinde chloride, thermoplastic polyimide resin, polyamide resin, modified polyphenylene oxide resin and the like, various modified resins and copolymers of these can be used alone or in combination of two or more kinds of the resins. However, the present invention will not be limited to the above described materials.

Next, additives for mixture to adjust electric resistance value of the intermediate transfer belt to be used in the process cartridge of the present invention will not be limited in particular, and as conductive filler to adjust resistance, carbon black and various kinds of conductive metal oxides, etc. are used and as non-filler system resistance adjusting agent, ion conducting member with low molecular weight such as various kinds of metallic salts and glycols and antistatic resin containing an ether bond or a hydroxyl group, etc. in the molecule or organic high-molecular compounds showing electronic conduction are used.

What is necessary here is a dispersion state of these additives and the components constructing the intermediate transfer belt such as resins, and while cohesion of the particles or extreme separation of a part of the components takes place, it is difficult to attain the effects of the present invention. Selection is important with respect to the materials and the dispersion means.

A method of forming the intermediate transfer belt may preferably be a method that enables manufacture of seamless belts and that features high manufacturing efficiency and can control costs. The method for that purpose may include such a method that executes continuous melt extrusion from a cylinder-type die and thereafter cuts the extruded product into a form with a necessary length to produce a belt. For example, blow-extrusion (inflation) molding is suitable.

An example of method for producing the intermediate transfer belt of the present invention will be described below. However, the present invention will not be limited thereto.

Figure 4:
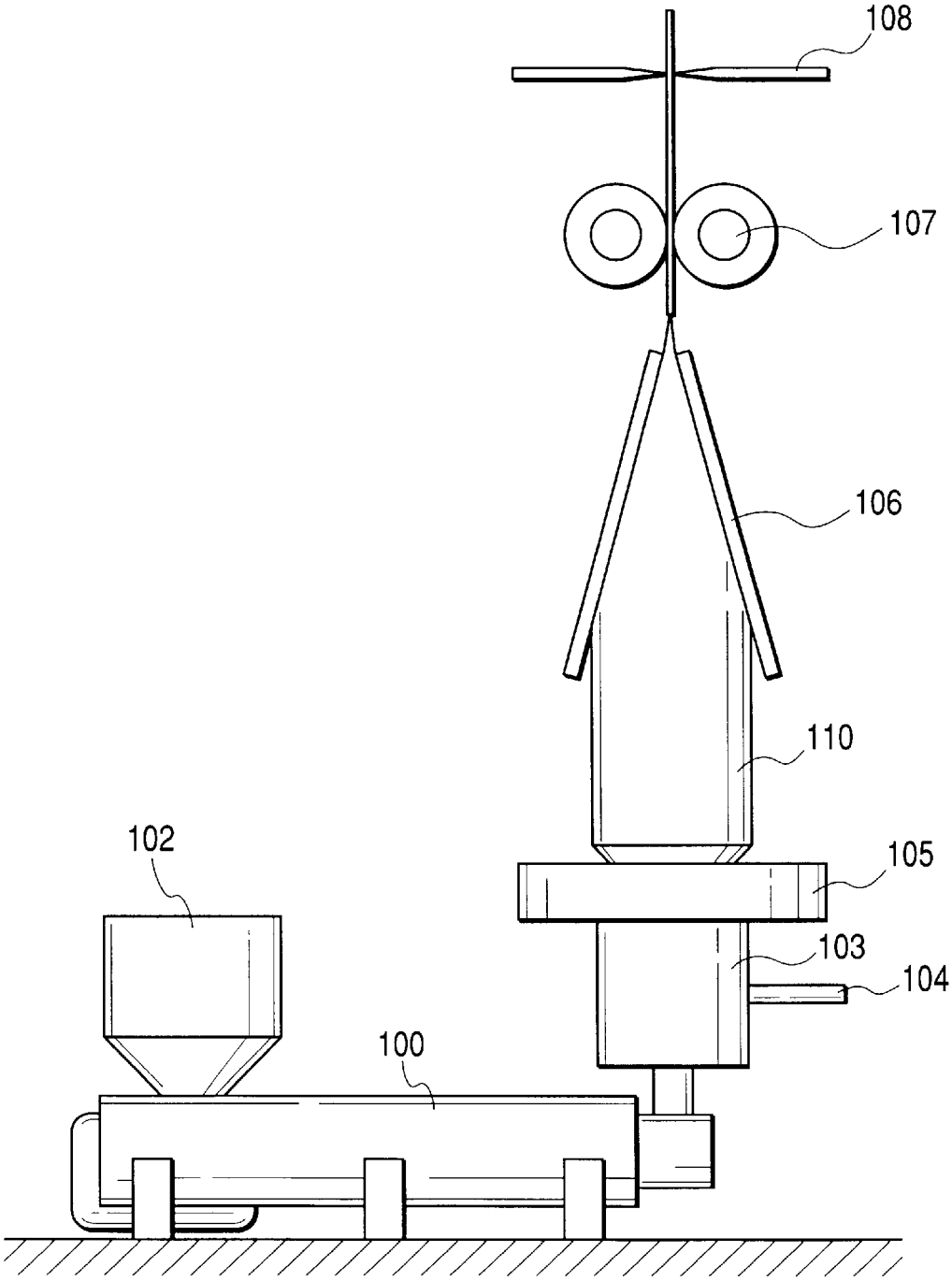
FIG. 4 is a schematic constructural view of an extrusion apparatus of forming an intermediate transfer belt of the present invention.

An apparatus for forming the intermediate transfer belts of the present invention is schematically shown in FIG. 4. The present apparatus basically comprises an extruder, an extruder die and a gas blowing unit.

Firstly, an extrusion resin, a conducting agent, and additives etc. are preliminarily mixed in advance in accordance with a desired formulation and thereafter kneaded and dispersed to prepare an extrusion material, which is then put into a hopper 102 provided to a pressing machine 100.

The extrusion 100 has a preset temperature and extruder screw construction is selected which are so selected that the extrusion material may have a melt viscosity necessary for enabling the extrusion into a belt in the subsequent steps and also the materials can uniformly be dispersed each other.

The extrusion material is melt-kneaded in the extruder 100 into a melt, which then enters the cylinder-type extruder die 103. In the cylinder-type die 103, a gas inlet passage 104 is disposed, and air is blown into the center of the cylinder-type die 103 from the gas inlet passage 104 so that the melted body having passed through the die 103 inflates while scaling up in the radius direction to be a cylinder film 110.

At this time, as the gas to be blown in, beside the air, nitrogen, carbon dioxide or argon etc. can be selected. The extruded product having thus inflated into a cylinder is drawn upward while being cooled with the external cooling ring 105.

Normally, for the inflation apparatus, a method is adapted in which the product in the tubular form is crushed from the left and the right with the stabilizing plate 106 and folded into a sheet and it is then sandwiched by a pinch roller 107 without the internal air coming out so that it is drawn at a constant speed.

Subsequently, the drawn film is cut with a cutting apparatus 108 so as to provide a cylindrical film in a desired size.

Next, processing using molds is implemented for adjusting the surface smoothness and size of this cylinder film and removing crease left in the film at the time of extrusion and the like. Specifically, there is a method to use a pair of cylinder molds with different diameters made of material with different heat thermal expansion rates.

Figure 9:
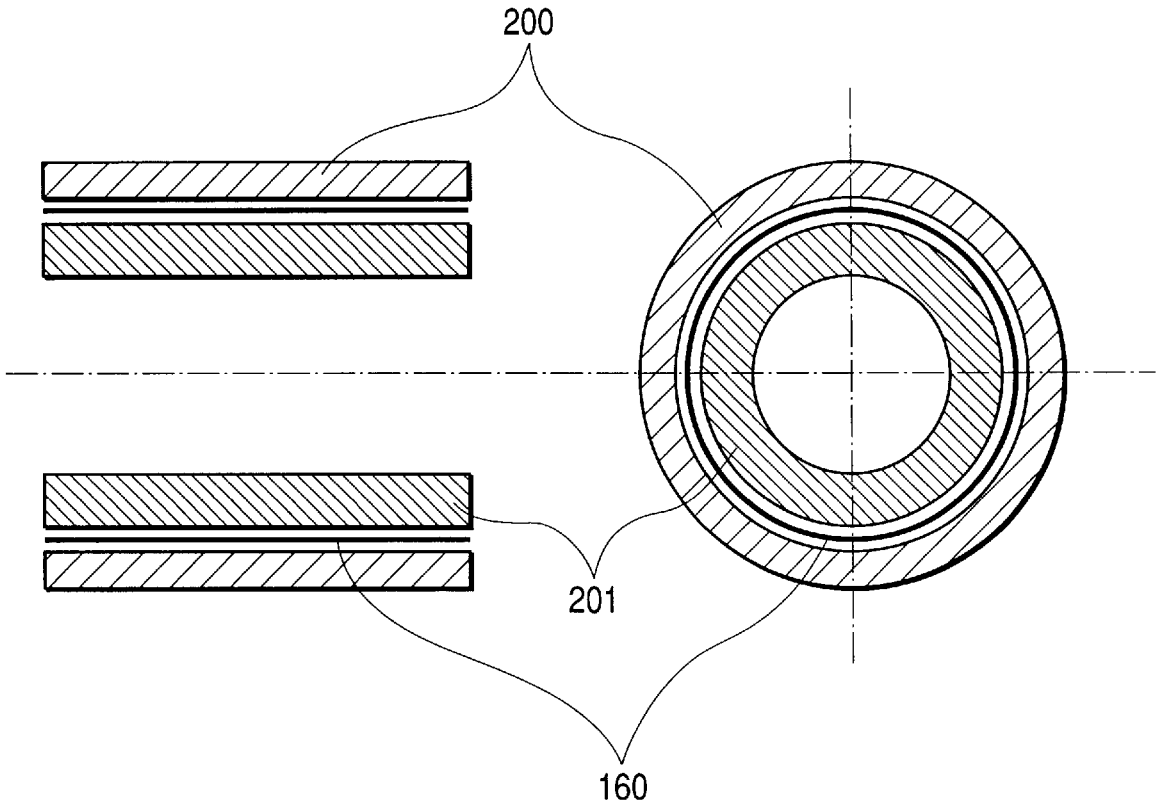
FIG. 9 is a view showing an appearance of processing using a mold of a tubular film.

The heat thermal expansion rate of the cylinder mold with a small diameter (internal mold 201) is set to get larger than the heat thermal expansion rate of the cylinder mold with a large diameter (external mold 202). After this internal mold is covered with a cylinder film 160 extruded, that internal mold is inserted into the external mold in such a fashion that the internal mold and the external mold sandwich the cylinder film (FIG. 9).

The gap between the molds is given subject to calculation from the heating temperature, a difference in the heat thermal expansion rates between the internal mold and the external mold, and the pressure regarded as necessary.

The molds are set in the order of the internal mold 201, the cylinder film 160 and the external mold 200 and then heated to reach near the softening point temperature of the cylinder film resin. The internal mold 201 with larger thermal expansion rate is heated to expand larger than the external mold 200 and a pressure is uniformly applied to all over the cylinder film 160. At this time, the surface of the cylinder film 160 that has reached near the softening point is pushed to the inner face of the external mold that underwent processing to be smooth and flat so that the smoothness or flatness of the surface of the cylinder film 160 is improved.

Thereafter, the molds are cooled, and the cylinder film 160 is taken away from the molds to give rise to smooth surface property.

Hereafter, reinforcement members and guide members or position detecting members are attached as needed and accurate cutting is implemented so as to produce the intermediate transfer belt.

Figure 3:
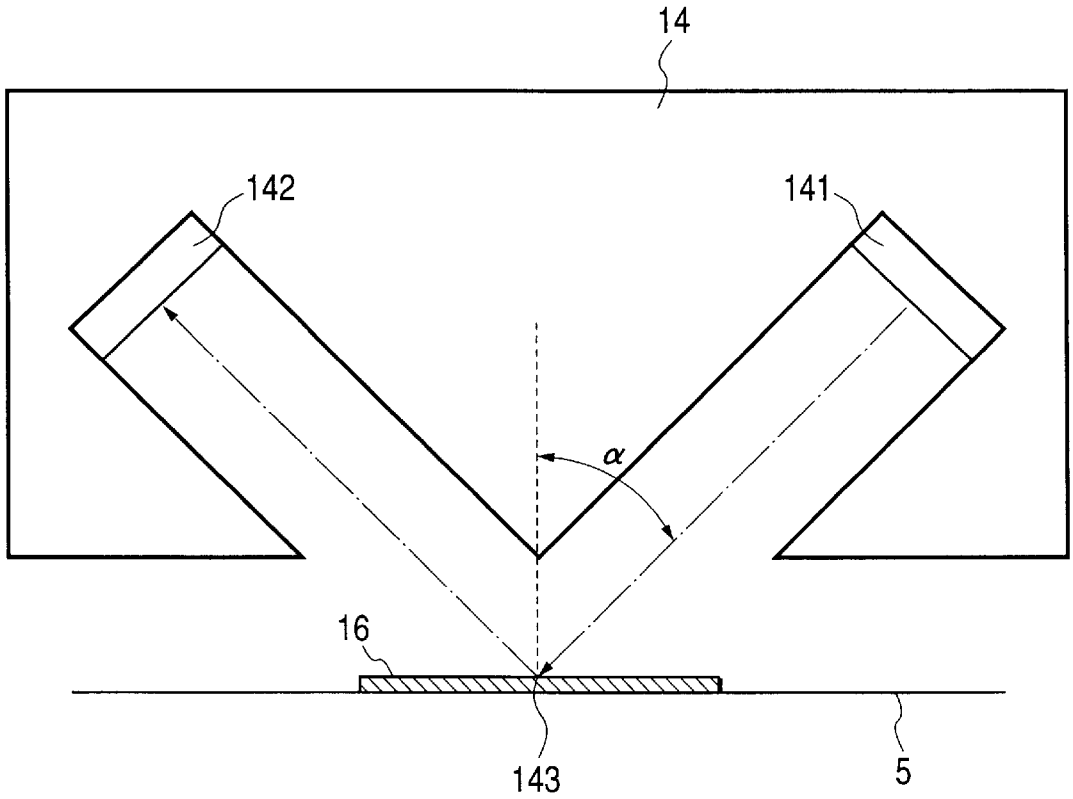
FIG. 3 is a schematic constructural view of a density detection sensor.

Next, with reference to FIG. 3, a density detecting sensor 14 as density detecting means will be briefly described.

The density detecting sensor 14 is a one that detects an image of predetermined test pattern (registration detecting pattern or density detecting pattern) that is formed on the electrophotographic photosensitive member with controlling the electrically charging means and the developing means etc. as process means and is then transferred onto the intermediate transfer belt 5 from the electrophotographic photosensitive member.

As shown in FIG. 3, the density detecting sensor 14 has a light-emitting element 141 such as an LED and a light-receiving element 142 such as a photodiode.

Exposure light from the light-emitting element 141 goes incident at an angle of $\alpha$ against the intermediate transfer belt 5 and is then reflected at the detecting position 143. The light-receiving element 142 is provided at the position to detect a regular reflection component of the exposure light.

The amount of light as reflected at this detecting position 143 is determined by the reflection rate of the underlying intermediate transfer belt 5 and the amount of toner in the density patch 16 of the test pattern image. When the toner amount of the density patch 16 increases, the surface of the underlying intermediate transfer belt 5 is concealed to that effect and the output from the sensor is decreased accordingly.

Incidentally, in FIG. 3, the density detecting sensor 14 used is of a regular reflection light detecting type, but without limitation hereto, diffusing light detecting type sensor, for example, may be used.

Next, an example of an electrophotographic apparatus using an intermediate transfer belt-electrophotographic photosensitive member integrated process cartridge of the present invention is shown in FIG. 1.

FIG. 1 shows a full-color electrophotographic apparatus (a photocopier or a laser beam printer).

Reference numeral 1 denotes an electrophotographic photosensitive member of a rotating drum type repeatedly used as a first image bearing member, and is driven for rotation at a predetermined peripheral velocity (process speed) in the direction of an arrow.

The electrophotographic photosensitive member 1 undergoes electrical charging treatment uniformly at a predetermined polarity and potential with the primary charging means 2 in the course of the rotation. To the power source 32 of the primary electrifying means is applied a voltage formed by superimposing an alternate current voltage onto direct current voltage, but only the direct current will do.

Subsequently, the photosensitive member 1 receives light 3 from not-shown exposing means (color separation-image forming exposure optical system of a color image of original, scanning exposure system with a laser scanner outputting laser beams modulated in accordance with time-sequential electric digital pixel signal of image information, and the like), whereby an electrostatic latent image is formed corresponding to the first color component image (for example, yellow color component image) of the desired full color image.

Next, the electrostatic latent image is developed with a first-color, yellow toner Y, by use of a first developing means (yellow color developing means 41). At this time, the respective developing means of second to forth developing means (magenta color developing means 42, cyan color developing means 43 and black color developing means 44) are operated off not to act on the electrophotographic photosensitive member 1 and the first color, yellow toner image is not affected by the second to forth developing means.

The intermediate transfer belt 5 is driven for rotation at a predetermined peripheral speed (process speed) in the direction of an arrow.

The above described first yellow toner image formed and carried on the electrophotographic photosensitive member 1 passes through the contact part between the electrophotographic photosensitive member 1 and the intermediate transfer belt 5, in the course of which it is successively primarily transferred to the external circumference face of the intermediate transfer belt 5 by the aid of an electric field formed by the primary transfer bias applied onto the intermediate transfer belt 5 from the primary transfer means 6.

The surface of the electrophotographic photosensitive member 1 having completed transfer of the first color yellow toner image to the intermediate transfer belt 5 is cleaned with electrophotographic photosensitive member cleaning means 13.

Subsequently, likewise the second color magenta toner image, the third color cyanogens toner image and the forth color black toner image are sequentially transferred superimposingly onto the intermediate transfer belt 5, and a synthesized color toner image corresponding to the intended full color image is formed.

The primary transfer bias for sequentially superimposing transferring the first to the forth toner images from the electrophotographic photosensitive member 1 to the intermediate transfer belt 5 is applied from a bias source 30 in a polarity (+) reverse to that of each toner. The voltage thus applied is, e.g., in the range of from +100V to 2 kV.

Reference numeral 7 denotes a secondary transfer means (secondary transfer roller) that is borne in parallel with the secondary transfer roller 8 and is disposed in the bottom face of the intermediate transfer belt 5 in a state capable of being separable therefrom, and in the step of primary transfer of the first to the third color toner images from the electrophotographic photosensitive member 1 to the intermediate transfer belt 5, the secondary transfer means 7 can be separated from the intermediate transfer belt 5.

For further transfer of a synthesized color toner image transferred onto the intermediate transfer belt 5 to a transfer material P as a second image bearing member, the secondary transfer means 7 are brought into contact with the intermediate transfer belt 5, and the transfer material P is fed to the contact part between the intermediate transfer belt 5 and the secondary transfer means 7 at a predetermined timing from a paper feeding roller 11 through a transfer material guide 10 and a secondary transfer bias is applied to the secondary transfer means 7 from the source 31. With the aid of this secondary transfer bias, a synthesized color toner image is secondarily transferred from the intermediate transfer belt 5 to the transfer material P being the second image bearing member.

The transfer material P having received the transfer of the toner images is then introduced into the fixing means 15 to undergo heat fixing.

After completion of the transfer of the toner images onto the transfer material P, electric charge providing means 9 is brought into contact with the intermediate transfer belt 5, where the charge providing means is disposed freely in a separate/contact state relative to the charge providing means, and a bias with a reverse polarity to that of the electrophotographic photosensitive member 1 is applied so that electric charges with a reverse polarity to that at the time of the primary transfer are given to the toners not transferred to transfer material P and remaining on the intermediate transfer belt 5 (i.e., transfer residual toners). To the bias power source 33 is applied a voltage formed by superimposing a direct current voltage to alternate current voltage.

The above described transfer residual toners electrified to the reverse polarity to that at the time of the primary transfer are electrostatically transferred to the electrophotographic photosensitive member 1 at the contact part of the intermediate transfer member with the electrophotographic photosensitive member 1 as well as in the vicinity thereof so that the intermediate transfer member is cleaned. Since this step can be implemented simultaneously with the primary transfer, reduction in throughput does not occur.

Subsequently, an intermediate transfer belt-electrophotographic photosensitive member integrated process cartridge of the present invention will be described.

Figure 2:
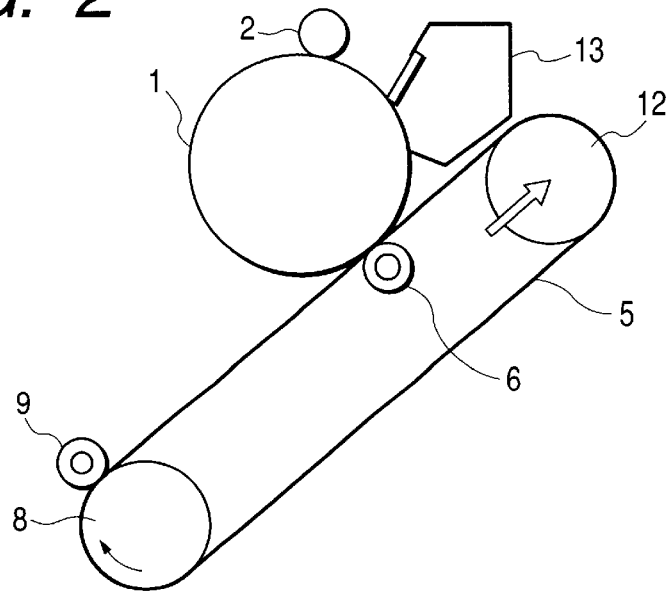
FIG. 2 is a schematic view of an intermediate transfer belt-electrophotographic photosensitive member integrated process cartridge of the present invention.

The process cartridge of the present invention is constructed as shown in FIG. 2 as a one-body unit, comprising at least an intermediate transfer belt 5, an electrophotographic photosensitive member 1 and an electric charge providing means 9, and preferably, constructed as one-body unit also comprising electrophotographic photosensitive member cleaning means 13. The process cartridge is detachably mountable to the main body of the electrophotographic apparatus.

Cleaning of the intermediate transfer belt of the present invention is a mechanism necessary for the transfer residual toners to be charged to a polarity reversed to that of the primary transfer as mentioned above and thereby returned to the electrophotographic photosensitive member in the primary transfer part. The process cartridge shown in the present drawing comprises an electric charge providing means 9 made of an elastic body with medium resistance.

In the present drawing, cleaning of the electrophotographic photosensitive member is performed using blade cleaning. If a waste toner container (not shown) is also integrally provided, the transfer residual toners on both the intermediate transfer belt and the electrophotographic photosensitive member can simultaneously be discarded when the process cartridge is exchanged. Thus, it contributes to improvement in maintenance performance.

Also, the intermediate transfer belt is put over two rollers 8 and 12, so that the number of component parts can be made small and the cartridge can be made compact.

In the present drawing, reference numeral 8 denotes a driving roller and at the same time an opposing roller of the electric charge providing means in the roller shape.

A tension roller 12 that rotates corresponding with the intermediate transfer belt has a sliding mechanism and is brought into pressure contact in the direction of an arrow with a compressing spring to give tension to the intermediate transfer belt. It may preferably be slidable in a slide width of from 1 to 5 mm. Also, the spring may preferably apply a total pressure of from 5 to 100N.

In addition, the electrophotographic photosensitive member 1 and the driving roller 8 have a not-shown coupling so that the rotation drive force is transmitted from the main body.

Figure 5:
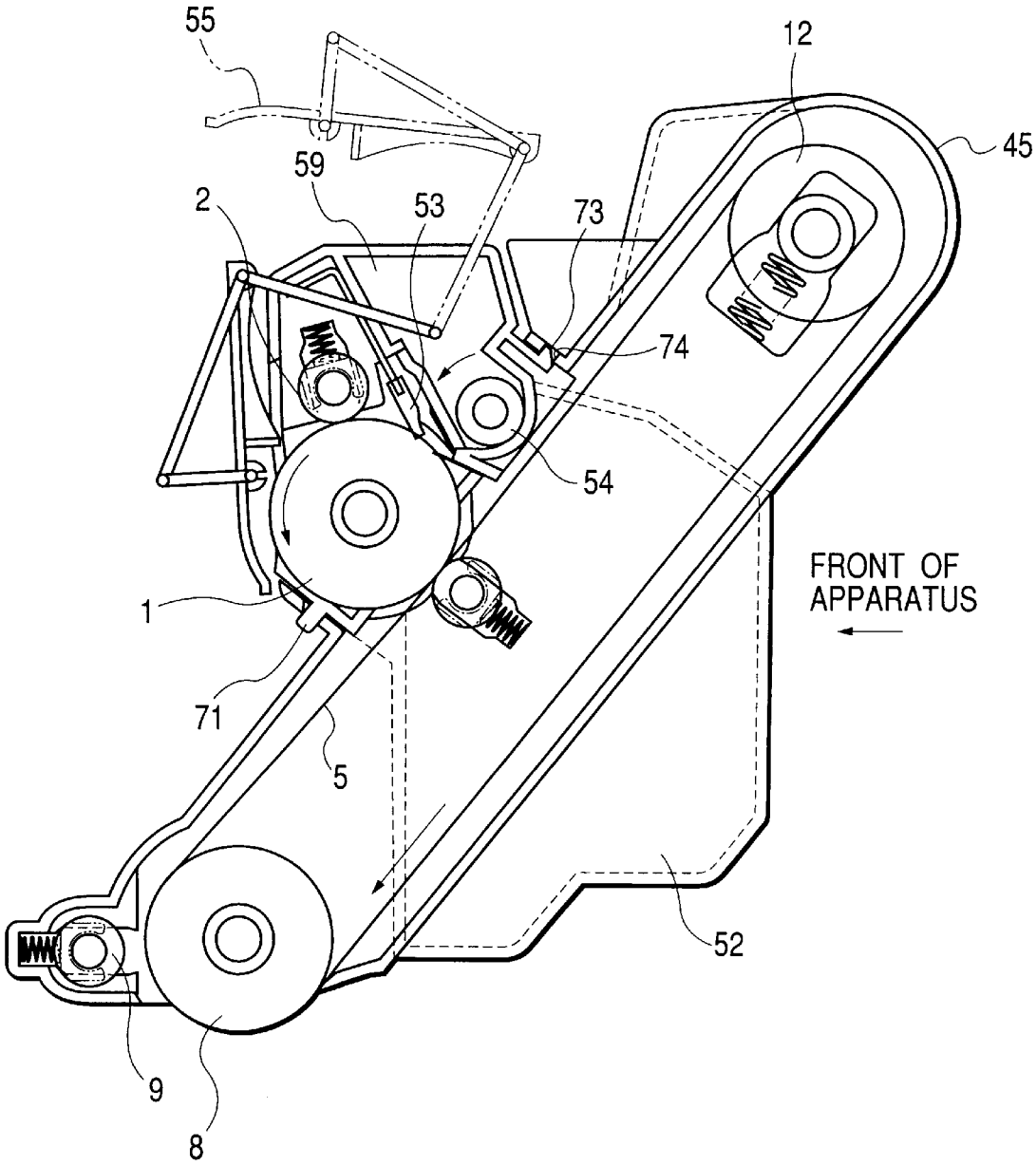
FIG. 5 is a schematic constructural view of a process cartridge, which is used in Examples and Comparison examples, constructed with an electrophotographic photosensitive member unit and intermediate transfer belt unit being connected.

FIG. 5 schematically illustrates a process cartridge constructed by connecting an electrophotographic photosensitive member unit having an electrophotographic photosensitive member and an intermediate transfer belt unit having an intermediate transfer belt.

Figure 6:
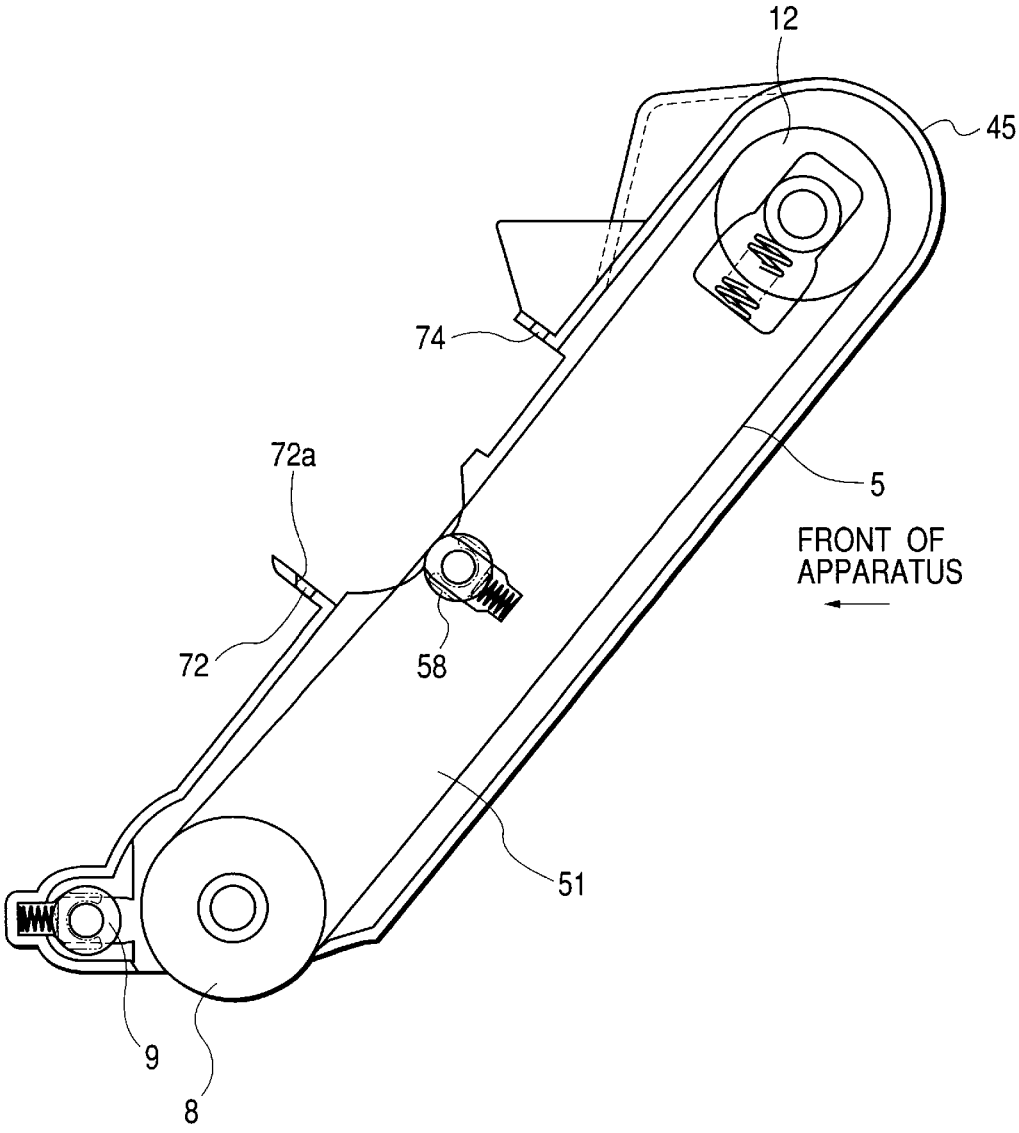
FIG. 6 is a schematic constructural view of an intermediate transfer belt unit.
Figure 7:
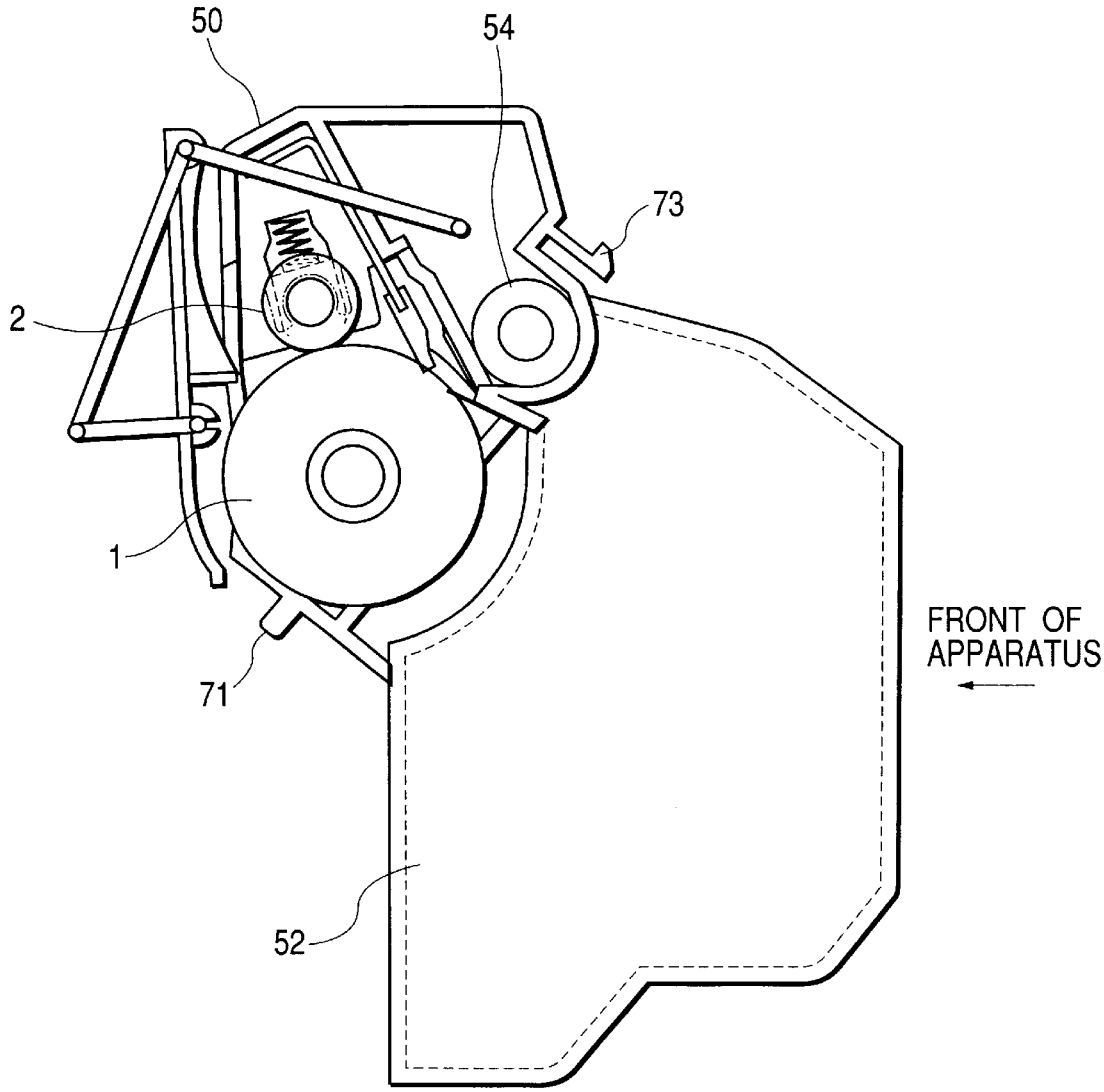
FIG. 7 is a schematic constructural view of an electrophotographic photosensitive member unit.

In addition, FIG. 6 and FIG. 7 schematically illustrate an intermediate transfer belt unit and an electrophotographic photosensitive member unit, respectively.

The frame construction is roughly divided into two. The construction is divided into an electrophotographic photosensitive member unit 50 as shown in FIG. 7 and an intermediate transfer belt unit 51 as shown in FIG. 6. The electrophotographic photosensitive member unit 50 comprises in a electrophotographic photosensitive member frame 59 constructed as one body together with the waste toner container 52, the electrophotographic photosensitive member 1, the charging roller 2, the cleaning blade 53, the screw 54, and the drum shutter 55 as the main components, and the intermediate transfer belt unit 51 comprises in an intermediate transfer belt frame 45 the intermediate transfer belt 5 wound and put over the drive roller 8 and the driven roller 12, the primary transfer roller 58 disposed inside the intermediate transfer belt facing the electrophotographic photosensitive member 1 and the electric charge providing means (the intermediate transfer belt cleaning roller) 9 disposed relative to the drive roller 8.

As for these two units, protrusions 71 provided in the both left and right ends of the electrophotographic photosensitive member frame 59 are respectively inserted into the positioning holes 72 provided in the intermediate transfer belt frame 45, and on the other hand, a nail 73 of hook part of a snap fit form provided in the center of the longitudinal direction of the electrophotographic photosensitive member frame 59 is engaged into a lock hole 74 of the intermediate frame 45 for connection.

Here, the positioning holes 72 provided in the intermediate transfer belt frame 45, and the lock hole 74 are provided with holes sized larger by a predetermined quantity than the protrusions 71 provided in the electrophotographic photosensitive member frame 59 and the hook part nail 73, and are constructed to permit relative positional movements of a predetermined amount between the electrophotographic photosensitive member unit 50 and the intermediate transfer belt unit 51.

In addition, the positioning holes 72 are provided with taper parts 72*a* for easy attachment/detachment.

In FIG. 7, the hook part nail 73 of the electrophotographic photosensitive member unit 50 is pushed so as to be taken off from the lock holes 74 of the intermediate transfer belt unit 51, and the electrophotographic photosensitive member unit 50 is rotated, and thus as shown in FIG. 6 and FIG. 7, division into the electrophotographic photosensitive member unit and the intermediate transfer belt unit can be executed.

At the time of connection, on the contrary to the above described, the protrusions 71 of the electrophotographic photosensitive member unit 50 are inserted into the positioning holes 72 of the intermediate transfer belt unit 51 and rotation in the opposite direction to the case of removal is implemented and the hook part nail 73 is pushed into the lock hole 74 to thereby connect the two units.

Figure 8:
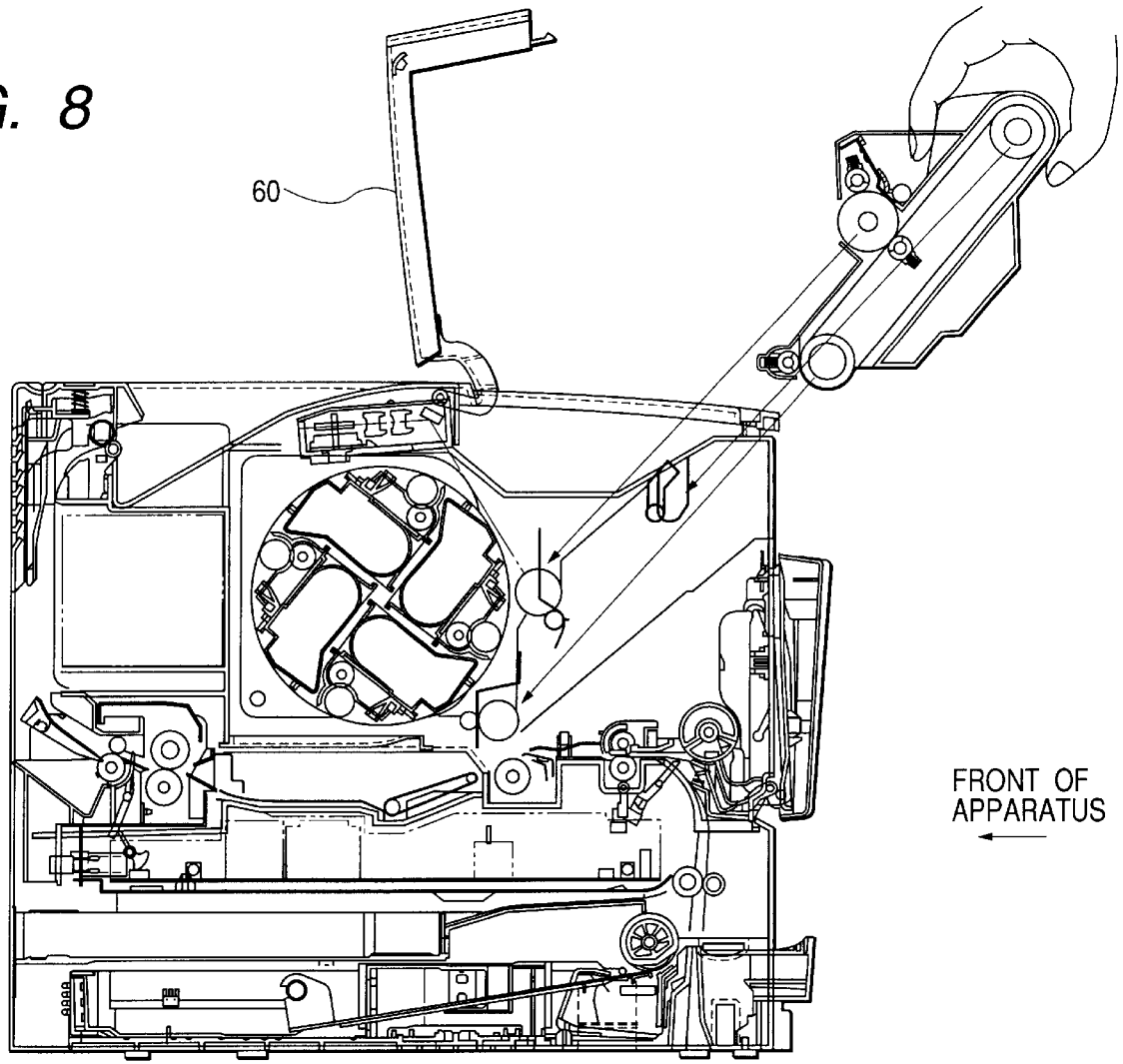
FIG. 8 is a view showing an appearance at the time of attachment to and removal from an electrophotographic photosensitive apparatus of a process cartridge of the present invention.

FIG. 8 shows appearance when a process cartridge of the present invention is attached to/removed from an electrophotographic apparatus.

Only an upper cover 60 of the electrophotographic apparatus main body is opened, attachment/detachment of the process cartridge can be implemented simply as in a conventional black and white laser beam printer so that maintenance such as jam treatment and process cartridge exchange can be implemented easily.

The present invention will be described in further detail with reference to Examples. The "part(s)" in the examples refers to part(s) by weight.

EXAMPLE 1

| | |
|---|---|
| Polyvinylidene fluoride resin (PVDF) | 100 parts |
| Polyether ester amide (polyether-containing pantistatic resin: Pelestat NC6321: Produced by Sanyo Chemical Industries, Ltd.) | 15 parts |

These materials were melt-kneaded at 210° C. by means of a twin-screw extruder to mix the materials, and the mixture obtained was extruded in the shape of a strand having a diameter of about 2 mm, followed by cutting into pellets. This is designated as an extrusion material 1.

Next, in the extrusion apparatus shown in FIG. 4, the extruder die was set as a circular die for single layer, and one having a die slit diameter of 100 mm was used. The die slit was 0.8 mm.

The above described extrusion material 1 having been well dried by heating, was put into a material hopper 102 of this extrusion apparatus, and heated and melted. The molten @product was extruded into a cylinder shape at 210° C. from the die.

An external cooling ring 105 is disposed around the die, and air was blown from the circumference onto the extruded film to effect cooling.

In addition, air was blown into the interior of the extruded tubular film from the gas inlet passage 104 to cause the film to inflate while scaling up to have a diameter of 140 mm. Thereafter, the film was continuously drawn off at a constant speed with a draw-off unit.

Here, introduction of the air was stopped at the time when the diameter reached the desired value.

Moreover, subsequent to the draw-off through the pinch rollers, the tubular film was cut with a cutter 108.

The film was cut in a length of 310 mm after the thickness was stabilized to 100 $\mu$m to form a tubular film 1.

On the tubular film 1, the size and surface smoothness were regulated and folds were removed by means of a set of cylindrical molds of metals with different coefficients of thermal expansion.

For the internal mold, an aluminum material with a higher thermal expansion coefficient was used, and for the external mold, a stainless steel with a thermal expansion coefficient lower than that of the aluminum was used. The external mold had been buffed on its inside surface to have a smooth surface like mirror face. The size gap between the outer diameter of the internal mold and the inner diameter of the external mold was set at 170 $\mu$m.

The tubular film 1 was place over the internal mold with a higher thermal expansion coefficient. The internal mode was then inserted into the external mold with the inner face having been processed into a smooth face (surface roughness Ra=0.048 $\mu$m), followed by heating at 170° C. for 20 minutes.

After cooling, the film was removed from the molds to cut the ends away, and with the aid of a meandering-preventing member, an intermediate transfer belt (1) with a diameter of 140 mm was produced.

The glossiness of the intermediate transfer belt was measured in accordance with the measurement method of the present invention to find that the average glossiness was 70.0 and the deviation of glossiness was 5.0. In addition, the film thickness was measured to find that the average film thickness was 101.3 $\mu$m and unevenness of film thickness was ±9.6%.

This intermediate transfer belt (1) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 15N.

This process cartridge was disposed in the electrophotographic apparatus shown in FIG. 1, and full color image print test was carried out to 80 g/m$^2$ paper.

The exposing apparatus used at this occasion was set to adopt a 600 dpi digital laser system.

In addition, this electrophotographic apparatus has a density detecting sensor shown in FIG. 3.

The initial image was evaluated visually, and as a result, the density detection was executed without any problem, giving rise to good full color images without density unevenness for each image.

Subsequently, endurance print test was carried out continuously with 10,000 sheets at the speed of four sheets per minute, and likewise the images were evaluated to find that good full color images were obtained which were free of any density unevenness for each image same as in the initial image.

In addition, a process cartridge was produced in the same manner as in the above described case and was left to stand for a month in the environment of 23° C./55%RH, and print test was executed, thereby obtaining good full color images without any density unevenness for each image.

Incidentally, images were assessed as bellow.

A: Very good

B: Good

C: Not good

"C" means that the effects of the present invention were not attained.

EXAMPLE 2

An intermediate transfer belt (2) was produced in the same manner as in Example 1 except that an external mold having undergone the blast treatment in the inner surface (Surface roughness Ra=0.098 $\mu$m) was used.

The intermediate transfer belt (2) was found to have an average glossiness of 40.6 and a deviation of glossiness of 5.0.

In addition, the average film thickness was 101.2 μm, and the unevenness of film thickness was ±8.8%.

This intermediate transfer belt (2) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 15N.

The image evaluation was carried out in the same manner as in Example 1, and in all the cases of the initial stage, after 10,000 sheet printing, and after one-month leaving to stand, good full color images were obtained without giving rise to any density unevenness for each image.

EXAMPLE 3

An intermediate transfer belt (3) was produced in the same manner as in Example 1 except that an external mold having undergone the blast treatment in the inner surface (Surface roughness Ra=0.123 μm) was used.

The intermediate transfer belt (3) was found to have an average glossiness of 35.0 and a deviation of glossiness of 4.8. In addition, the average film thickness was 100.3 μm, and the unevenness of film thickness was ±8.9%.

This intermediate transfer belt (3) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 15N. The image evaluation was carried out in the same manner as in Example 1, and as a result, slight unevenness of density occurred for each image in the initial stage but was within a level causing no problems.

In addition, after 10,000 sheet print and after one month leaving to stand, the results were substantially in the same level as the initial stage.

EXAMPLE 4

| | |
|---|---|
| Polycarbonate A | 100 parts |
| Polyether ester amide (polyether-containing antistatic resin: Pelestat NC6321: Produced by Sanyo Chemical Industries, Ltd.) | 15 parts |

An intermediate transfer belt (4) was produced in the same manner as in Example 1 except that the above described materials were used.

The intermediate transfer belt (4) was found to have an average glossiness of 87.2 and the deviation of glossiness of 5.0. In addition, the average film thickness was 101.3 μm, and the unevenness of film thickness was ±9.5%.

This intermediate transfer belt (4) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 15N.

The image evaluation was carried out in the same manner as in Example 1 to find that good full color images were obtained without giving rise to any density unevenness for each image.

After 10,000 sheet print, slight unevenness in density occurred but was in the level causing no problems.

Also after one month leaving to stand, the results were the same.

EXAMPLE 5

An intermediate transfer belt (5) was produced in the same manner as in Example 1 except that the inner diameter of the external mold was changed with the gap between the internal mold and the external mold being set at 180 μm.

Then the tubular film placed over the internal mold at the time of heating was not completely brought into close contact with the external mold, and therefore glossiness unevenness took place on the surface of the film.

The intermediate transfer belt (5) was found to have an average glossiness of 69.8 and a deviation of glossiness of 9.6.

In addition, the average film thickness was 100.8 μm, and the unevenness of film thickness was ±8.9%.

This intermediate transfer belt (5) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 15N.

The image evaluation was carried out in the same manner as in Example 1 to find that slight unevenness of density occurred for each image in the initial stage but was within a level causing no problems.

In addition, after 10,000 sheet print and after one month leaving to stand, the results were in the same level as the initial stage.

EXAMPLE 6

An intermediate transfer belt (6) was produced in the same manner as in Example 1 except that a tubular film having a film thickness of 145 μm was used and the inner diameter of the external mold was changed with the gap between the internal mold and the external mold being set at 200 μm.

The intermediate transfer belt (6) was found to have an average glossiness of 69.6 and a deviation of glossiness of 4.4.

In addition, the average film thickness was 144.6 μm, and the unevenness of film thickness was ±8.6%.

This intermediate transfer belt (6) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 15N.

The image evaluation was carried out in the same manner as in Example 1 to find that in the initial stage and after 10,000 sheet print, no unevenness of density occurred for each image, but good full color images were obtained.

After one month leaving to stand, unevenness of density took place more or less but was in a level causing no problems.

EXAMPLE 7

An intermediate transfer belt (7) was produced in the same manner as in Example 1 except that a tubular film having a film thickness of 52 μm was used and the inner diameter of the external mold was changed with the gap between the internal mold and the external mold being set at 125 μm.

The intermediate transfer belt was found to have an average glossiness of 68.8 and a deviation of glossiness of 4.7.

In addition, the average film thickness was 52.1 μm, and the unevenness of film thickness was ±9.9%.

This intermediate transfer belt (7) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 15N.

The image evaluation was carried out in the same manner as in Example 1 to find that in the initial stage and after 10,000 sheet print, no unevenness of density occurred for each image, but good full color images were obtained.

After one month leaving to stand, unevenness of density took place more or less but was in a level causing no problems.

EXAMPLE 8

An intermediate transfer belt (8) was produced in the same manner as in Example 1 except that the temperature to produce a tubular film with the extrusion method was set at 190° C.

The intermediate transfer belt (8) was found to have an average glossiness of 69.3 and a deviation of glossiness of 4.8.

In addition, the average film thickness was 102.2 μm, and the unevenness of film thickness was ±20.0%.

This intermediate transfer belt (8) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 15N.

The image evaluation was carried out in the same manner as in Example 1 to find that in the initial stage and after 10,000 sheet print, no unevenness of density occurred for each image, but good full color images were obtained.

After one month leaving to stand, unevenness of density took place more or less but was in a level causing no problems.

EXAMPLE 9

An intermediate transfer belt (9) was produced in the same manner as in Example 1.

The intermediate transfer belt (9) was found to have an average glossiness of 69.7 and a deviation of glossiness of 4.7.

In addition, the average film thickness was 100.0 μm, and the unevenness of film thickness was ±9.3%.

This intermediate transfer belt (9) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 50N.

The image evaluation was carried out in the same manner as in Example 1 to find that in all the cases of the initial stage, after 10,000 sheet print, and after one-month leaving to stand, no density unevenness for each image occurred.

EXAMPLE 10

An intermediate transfer belt (10) was produced as in Example 1.

The intermediate transfer belt (10) was found to have an average glossiness of 68.5 and a deviation of glossiness of 4.9.

In addition, the average film thickness was 100.5 μm, and the unevenness of film thickness was ±9.5%.

This intermediate transfer belt (10) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 60N.

The image evaluation was carried out in the same manner as in Example 1 to find that slight unevenness of density occurred for each image in the initial stage but was within a level causing no problems.

In addition, after 10,000 sheet print and after one month leaving to stand, the results were in the same level as the initial stage.

EXAMPLE 11

An intermediate transfer belt (11) was produced as in Example 1.

The intermediate transfer belt (11) was found to have an average glossiness of 68.4 and a deviation of glossiness of 4.8.

In addition, the average film thickness was 99.6 μm, and the unevenness of film thickness was ±9.5%.

This intermediate transfer belt (11) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 1N.

The image evaluation was carried out in the same manner as in Example 1 to find that in all the cases of the initial stage, after 10,000 sheet print, and after one-month leaving to stand, no density unevenness for each image occurred.

EXAMPLE 12

An intermediate transfer belt (12) was produced as in Example 1.

The intermediate transfer belt (12) was found to have an average glossiness of 69.3 and a deviation of glossiness of 4.7.

In addition, the average film thickness was 101.2 μm, and the unevenness of film thickness was ±9.2%.

This intermediate transfer belt (12) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 0.5N.

The image evaluation was carried out in the same manner as in Example 1 to find that slight unevenness of density occurred for each image in the initial stage but was within a level causing no problems.

In addition, after 10,000 sheet print and after one month leaving to stand, the results were in the same level as the initial period.

Comparison Example 1

An intermediate transfer belt (13) was produced in the same manner as in Example 1 except that an external mold having undergone the blast treatment in the inner surface (Surface roughness Ra=0.173 μm).

The intermediate transfer belt (13) was found to have an average glossiness of 26.2 and a deviation of glossiness of 5.0.

In addition, the average film thickness was 100.1 μm, and the unevenness of film thickness was ±9.4%.

This intermediate transfer belt (13) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 15N.

The image evaluation was carried out in the same manner as in Example 1 to find that unevenness of density occurred for each image in the initial stage.

Also after 10,000 sheet print and after one month leaving to stand, the results were the same.

Comparison Example 2

| | |
|---|---|
| Thermoplastic polyimide resin | 100 parts |
| Carbon black | 15 parts |

The above-described materials were used and melted by heating and then formed into a cylindrical shape by means of the extrusion at 350° C. The temperature to produce a tubular film was set at 330° C. Except that the above-described materials were used, an intermediate transfer belt (14) was produced in the same manner as in Example 1.

The intermediate transfer belt (14) was found to have an average glossiness of 95.8 and a deviation of glossiness of 4.5.

In addition, the average film thickness was 100.6 μm, and the unevenness of film thickness was ±9.1%.

This intermediate transfer belt (14) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 15N.

The image evaluation was carried out in the same manner as in Example 1 to find that good full color images were obtained without giving rise to any density unevenness for each image in the initial stage.

However, after 10,000 sheet print, unevenness in density for each image occurred.

Also after one month leaving to stand, the results were the same.

Comparison Example 3

An intermediate transfer belt (15) was produced in the same manner as in Example 1 except that the inner diameter of the external mold was changed with the gap between the internal mold and the external mold being set at 190 μm. The tubular film placed over the internal mold at the time of heating was not completely brought into close contact with the external mold, and therefore glossiness unevenness took place on the surface of the film.

The average glossiness was 68.9 and the deviation of glossiness was 13.8. In addition, the average film thickness was 101.4 μm, and the unevenness of film thickness was ±8.6%.

This intermediate transfer belt (15) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 15N.

The image evaluation was carried out in the same manner as in Example 1 to find that unevenness of density occurred for each image in the initial stage.

Also after 10,000 sheet print and after one month leaving to stand, the results were the same.

Comparison Example 4

An intermediate transfer belt (16) was produced in the same manner as in Example 1 except that a tubular film having a film thickness of 200 μm was used and the inner diameter of the external mold was changed with the gap between the internal mold and the external mold being set at 270 μm.

The average glossiness was 69.9 and the deviation of glossiness was 4.4. In addition, the average film thickness was 200.2 μm, and the unevenness of film thickness was ±7.6%.

This intermediate transfer belt (16) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 15N.

The image evaluation was carried out in the same manner as in Example 1 to find that in the initial stage and after 10,000 sheet pring, no unevenness of density occurred for each image, but good full color images were obtained.

However, after one month leaving to stand, unevenness of density took place.

Comparison Example 5

An intermediate transfer belt (17) was produced in the same manner as in Example 1 except that a tubular film having a film thickness of 33 μm was used and the inner diameter of the external mold was changed with the gap between the internal mold and the external mold being set at 110 μm.

The average glossiness was 69.7 and the deviation of glossiness was 4.8. In addition, the average film thickness was 33.3 μm, and the unevenness of film thickness was ±9.9%.

This intermediate transfer belt (17) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 15N.

The image evaluation was carried out in the same manner as in Example 1 to find that in the initial stage, no unevenness of density occurred for each image, but good full color images were obtained. However, and at the time when 7,600th-sheet print test was carried out, the belt was destroyed to enter a state that printing was impossible.

Comparison Example 6

An intermediate transfer belt (18) was produced in the same manner as in Example 1 except that the temperature to produce a tubular film by the extrusion was set at 180° C.

The average glossiness was 69.4 and the deviation of glossiness was 4.2. In addition, the average film thickness was 100.4 μm, and the unevenness of film thickness was ±32.1%.

This intermediate transfer belt (18) is incorporated into the intermediate transfer belt-electrophotographic photosensitive member integrated process cartridge having construction shown in FIG. 5, and the pushing pressure of the intermediate transfer belt onto the electrophotographic photosensitive member at the time of the primary transfer was set at 15N.

The image evaluation was carried out in the same manner as in Example 1 to find that in the initial stage, no unevenness of density occurred for each image, but good full color images were obtained.

After 10,000 sheet print, unevenness of density took place more or less but was in a level causing no problems.

However, after one month leaving to stand, unevenness of density for each image took place.

The results of Example 1 to 12 and Comparison Examples 1 to 6 are shown in Table 1.

As described above, according to the present invention, it became possible that an intermediate transfer belt-electrophotographic photosensitive member integrated process cartridge that makes maintenance easy, can attain miniaturization as well as cost reduction of the apparatus, can perform density detecting measuring for controlling image forming conditions in more stable and more accurate fashion, and can provide excellent images corresponding with use conditions, an electrophotographic apparatus having the above-described process cartridge, and an image forming method using the above-described electrophotographic apparatus were provided.

What is claimed is:

1. A process cartridge detachably mountable to an electrophotographic apparatus main body, the process cartridge integrally comprising:

an electrophotographic photosensitive member to carry a toner image;

an intermediate transfer belt having a contact part with the electrophotographic photosensitive member;

primary transfer means to primarily transfer the toner image at the contact part from the electrophotographic photosensitive member to the intermediate transfer belt; and electric charge providing means to give electric charges in polarity opposite to the polarity of the toner at the time of the primary transfer to the toner on the intermediate transfer belt to return the toner on the intermediate transfer belt to the electrophotographic photosensitive member at the contact part to clean the intermediate transfer belt, wherein said intermediate transfer belt has an average glossiness, obtained in the circumference direction, of 30 to 90;

TABLE 1

| | Glossiness | | Film thickness | | | Image evaluation | | |
|---|---|---|---|---|---|---|---|---|
| | Average | Deviation | Average (μm) | Uneveness (%) | Pressing pressure* | Initial stage | After 10,000 sheet print | After one month leaving |
| Example 1 | 70.0 | 5.0 | 101.3 | ±9.6 | 15 | A | A | A |
| Example 2 | 40.6 | 5.0 | 101.2 | ±8.8 | 15 | A | A | A |
| Example 3 | 35.0 | 4.8 | 100.3 | ±8.9 | 15 | B | B | B |
| Example 4 | 87.2 | 5.0 | 101.3 | ±9.5 | 15 | A | B | B |
| Example 5 | 69.8 | 9.6 | 100.8 | ±8.9 | 15 | B | B | B |
| Example 6 | 69.6 | 4.4 | 144.6 | ±8.6 | 15 | A | A | B |
| Example 7 | 68.8 | 4.7 | 52.1 | ±9.9 | 15 | A | A | B |
| Example 8 | 69.3 | 4.8 | 102.2 | ±20.0 | 15 | A | A | B |
| Example 9 | 69.7 | 4.7 | 100.0 | ±9.3 | 50 | A | A | A |
| Example 10 | 68.5 | 4.9 | 100.5 | ±9.5 | 60 | B | B | B |
| Example 11 | 68.4 | 4.8 | 99.6 | ±9.5 | 1 | A | A | A |
| Example 12 | 69.3 | 4.7 | 101.2 | ±9.2 | 0.5 | B | B | B |
| Comparison example 1 | 26.2 | 5.0 | 100.1 | ±9.4 | 15 | C | C | C |
| Comparison example 2 | 95.8 | 4.5 | 100.6 | ±9.1 | 15 | A | C | C |
| Comparison example 3 | 68.9 | 13.8 | 101.4 | ±8.6 | 15 | C | C | C |
| Comparison example 4 | 69.9 | 4.4 | 200.2 | ±7.6 | 15 | A | A | C |
| Comparison example 5 | 69.7 | 4.8 | 33.3 | ±9.9 | 15 | A | Evaluation unavailable | |
| Comparison example 6 | 69.4 | 4.2 | 100.4 | ±32.1 | 15 | A | B | C |

Pressing pressure*: pushing pressure of the intermediate transfer belt onto the electrophotographic photosensitive member at the time of the primary transfer a glossiness deviation of within 10;

an average film thickness of 40 to 200 μm; and a film thickness unevenness of within ±20% relative to the average film thickness.

2. The process cartridge according to claim 1, further integrally comprising in addition to said electrophotographic photosensitive member, said intermediate transfer belt, said primary transfer means and said electric charge providing means, electrophotographic photosensitive member cleaning means to clean the electrophotographic photosensitive member;

the process cartridge being separable into an electrophotographic photosensitive member unit having the electrophotographic photosensitive member and an intermediate transfer belt unit having the intermediate transfer belt, and having connecting means to connect the electrophotographic photosensitive member unit and the intermediate transfer belt unit.

3. The process cartridge according to claim 1, wherein the pressing pressure of the intermediate transfer belt against the electrophotographic photosensitive member is 1 to 50N when the toner image is primarily transferred from the electrophotographic photosensitive member to the intermediate transfer belt at the contact part between said electrophotographic photosensitive member and said intermediate transfer belt.

4. The process cartridge according to claim 1, wherein said average glossiness obtained in a circumference direction of said intermediate transfer belt is 40 to 85;

said glossiness deviation is within 9;

said average film thickness is 60 to 140 μm; and said film thickness unevenness is within ±12% relative to said average film thickness.

5. The process cartridge according to claim 1, wherein said electrophotographic apparatus has density detecting means.

6. An electrophotographic apparatus comprising:

an electrophotographic photosensitive member to carry a toner image;

charging means to charge the electrophotographic photosensitive member;

exposing means to form an electrostatic latent image on the electrophotographic photosensitive member charged with the charging means;

developing means to develop with toner the electrostatic latent image on the electrophotographic photosensitive member formed with the exposing means to form a toner image on the electrophotographic photosensitive member;

an intermediate transfer belt having a contact part with the electrophotographic photosensitive member to perform, after the primary transfer of the toner image from the electrophotographic photosensitive member to the intermediate transfer belt, secondary transfer of the primarily transferred toner image to a transfer material;

primary transfer means to primarily transfer the toner image from the electrophotographic photosensitive member to the intermediate transfer belt at the contact part;

electric charge providing means to give electric charges in polarity opposite to the polarity of the toner at the time of the primary transfer to the toner on the intermediate transfer belt to return the toner on the intermediate transfer belt to the electrophotographic photosensitive member at the contact part to clean the intermediate transfer belt, and a process cartridge integrally comprising at least the electrophotographic photosensitive member, the intermediate transfer belt, the primary transfer means and the electric charge providing means and being detachably mountable to the electrophotographic apparatus main body, wherein said intermediate transfer belt has an average glossiness, obtained in the circumference direction, of 30 to 90;

a glossiness deviation of within 10;

an average film thickness of 40 to 200 μm; and a film thickness unevenness of within ±20% relative to the average film thickness.

7. The electrophotographic apparatus according to claim 6;

wherein said process cartridge further integrally comprising in addition to said electrophotographic photosensitive member, said intermediate transfer belt, said primary transfer means and said electric charge providing means, electrophotographic photosensitive member cleaning means to clean the electrophotographic photosensitive member;

the process cartridge being separable into an electrophotographic photosensitive member unit having the electrophotographic photosensitive member and an intermediate transfer belt unit having the intermediate transfer belt, and having connecting means to connect the electrophotographic photosensitive member unit and the intermediate transfer belt unit.

8. The electrophotographic apparatus according to claim 6, wherein the pressing pressure of the intermediate transfer belt against the electrophotographic photosensitive member is 1 to 50N when the toner image is primarily transferred from the electrophotographic photosensitive member to the intermediate transfer belt at the contact part between said electrophotographic photosensitive member and said intermediate transfer belt.

9. The electrophotographic apparatus according to claim 6, wherein said average glossiness obtained in a circumference direction of said intermediate transfer belt is 40 to 85;

said glossiness deviation is within 9;

said average film thickness is 60 to 140 μm; and said film thickness unevenness is within ±12% relative to said average film thickness.

10. The electrophotographic apparatus according to claim 6, further comprising density detecting means.

11. An image forming method comprising:

a charging step to charge an electrophotographic photosensitive member;

an exposing step to form an electrostatic latent image on the electrophotographic photosensitive member charged in the charging step;

a developing step to develop with a toner the electrostatic latent image on the electrophotographic photosensitive member formed in the exposing step to form a toner image on the electrophotographic photosensitive member;

a primary transfer step to primarily transfer the toner image formed in the developing step, with primary transfer means, from the electrophotographic photosensitive member to the intermediate transfer belt having a contact part with the electrophotographic photosensitive member;

a secondary transfer step to secondarily transfer the toner image primarily transferred in the primary transfer step to a transfer material;

an electric charge providing step to give electric charges in polarity opposite to the polarity of the toner at the time of the primary transfer step to the toner on the intermediate transfer belt with electric charge providing means; and an intermediate transfer belt cleaning step to return the toner on the intermediate transfer belt to the electrophotographic photosensitive member at the contact part to clean the intermediate transfer belt, said image forming method using the electrophotographic apparatus having a process cartridge, said process cartridge integrally comprising at least the electrophotographic photosensitive member, the intermediate transfer belt, the primary transfer means and the electric charge providing means and being detachably mountable to the electrophotographic apparatus main body, wherein said intermediate transfer belt has an average glossiness, obtained in the circumference direction, of 30 to 90;

a glossiness deviation of within 10;

an average film thickness of 40 to 200 $\mu$m; and a film thickness unevenness of within ±20% relative to the average film thickness.

12. The image forming method according to claim 11 further comprising an electrophotographic photosensitive member cleaning step to clean said electrophotographic photosensitive member after said intermediate transfer belt cleaning step;

wherein said process cartridge integrally comprising said electrophotographic photosensitive member, said intermediate transfer belt, said primary transfer means, said electric charge providing means, and further electrophotographic photosensitive member cleaning means to clean the electrophotographic photosensitive member; and the process cartridge is separable into an electrophotographic photosensitive member unit having the electrophotographic photosensitive member and an intermediate transfer belt unit having the intermediate transfer belt, and has connecting means to connect the electrophotographic photosensitive member unit and the intermediate transfer belt unit.

13. The image forming method according to claim 11, wherein said intermediate transfer belt is brought into contact with said electrophotographic photosensitive member under a pressing pressure of 1 to 50N in said primary transfer step.

14. The image forming method according to claim 11, wherein said average glossiness obtained in a circumference direction of said intermediate transfer belt is 40 to 85;

said glossiness deviation is within 9;

said average film thickness is 60 to 140 $\mu$m; and said film thickness unevenness is within ±12% relative to said average film thickness.

15. The image forming method according to claim 11, using an electrophotographic apparatus comprising density detecting means.

* * * * *